US009891556B2

(12) United States Patent
Izawa et al.

(10) Patent No.: US 9,891,556 B2
(45) Date of Patent: Feb. 13, 2018

(54) WET TYPE DEVELOPING DEVICE

(71) Applicant: MIYAKOSHI PRINTING MACHINERY CO., LTD., Narashino-shi, Chiba (JP)

(72) Inventors: Hideo Izawa, Narashino (JP); Kenji Takahashi, Narashino (JP); Hidenori Kosaka, Narashino (JP)

(73) Assignee: MIYAKOSHI PRINTING MACHINERY CO., LTD., Narashino-shi (JP)

( * ) Notice: Subject to any disclaimer, the term of this patent is extended or adjusted under 35 U.S.C. 154(b) by 0 days.

(21) Appl. No.: 15/350,791

(22) Filed: Nov. 14, 2016

(65) Prior Publication Data

US 2017/0219966 A1 Aug. 3, 2017

(30) Foreign Application Priority Data

Feb. 1, 2016 (JP) ..... 2016-017448

(51) Int. Cl.
*G03G 15/10* (2006.01)
*G03G 15/08* (2006.01)

(52) U.S. Cl.
CPC ..... *G03G 15/104* (2013.01); *G03G 15/08* (2013.01); *G03G 15/0815* (2013.01); *G03G 15/10* (2013.01)

(58) Field of Classification Search
CPC ..... G03G 15/104
USPC ..... 399/238, 239
See application file for complete search history.

(56) References Cited

U.S. PATENT DOCUMENTS 3,667,428 A * 6/1972 Smith ..... G03D 5/067 399/239
4,627,705 A * 12/1986 Landa ..... G03G 15/104 399/225
5,539,504 A * 7/1996 Hanson ..... G03G 15/11 399/239
2003/0129004 A1 7/2003 Cho et al.
2004/0005173 A1 1/2004 Park et al.
2005/0008403 A1* 1/2005 Kweon ..... G03G 15/0808 399/283

(Continued)

FOREIGN PATENT DOCUMENTS

EP 0899623 A2 3/1999
EP 2385431 A2 11/2011

(Continued)

OTHER PUBLICATIONS

Aug. 18, 2017 Extended European Search Report issued in European Patent Application No. 17152742.7.

*Primary Examiner* — Sandra Brase
(74) *Attorney, Agent, or Firm* — Oliff PLC

(57) ABSTRACT

A wet type developing device including a developing roller and an anilox roller, the wet type developing device includes: a dual purpose roller being opposite to the surface of the anilox roller, leaving a gap therebetween, upstream of a region of contact between the surfaces of the anilox roller and the developing roller and being in contact with the surface of the developing roller upstream of the region of contact between the surfaces of the anilox roller and the developing roller and being rotationally driven. A surface part of the dual purpose roller is made of a porous member that has flexibility and elasticity.

21 Claims, 6 Drawing Sheets

(56) References Cited

U.S. PATENT DOCUMENTS

| | | | | |
|---|---|---|---|---|
| 2005/0158082 | A1* | 7/2005 | Shin | G03G 15/11 399/237 |
| 2011/0249990 | A1* | 10/2011 | Izawa | G03G 15/104 399/238 |
| 2012/0237266 | A1* | 9/2012 | Miyazawa | G03G 15/104 399/238 |

FOREIGN PATENT DOCUMENTS

| | | | |
|---|---|---|---|
| EP | 2896997 | A1 | 7/2015 |
| JP | H09-305029 | A | 11/1997 |
| JP | 2012-068372 | A | 4/2012 |

* cited by examiner

WET TYPE DEVELOPING DEVICE

TECHNICAL FIELD

The present invention relates to a wet type developing device of the electrophotographic printer, for detail the wet type developing device developing an electrostatic latent image formed on a surface of a photoconductor drum with a liquid toner.

BACKGROUND ART

A wet type developing device of the electrographic printer is disclosed in JP 2012-68372 A.

This wet type developing device comprises, a developing roller in contact with a surface of a photoconductor drum, and an anilox roller (convexo-concave roller) in contact with a surface of the developing roller and in part of its surface immersed in a liquid toner. The developing roller and the anilox roller are driven to rotate so that the liquid toner is supplied onto the surface of the developing roller via the anilox roller, the developing roller develops an electrostatic latent image formed on the surface of the photoconductor drum with the liquid toner which was supplied.

The anilox roller of the wet type developing device which comprises the anilox roller and the developing roller is as follows.

The anilox roller has cells (recesses) formed on its surface and rotates to convey the liquid toner filled in the cells so that the filled liquid toner is delivered to the surface of the developing roller.

Because an extra liquid toner overflowed from the cells then exists on the surface of the anilox roller, a regulation blade is made to come in contact with the surface of the anilox roller to scrape off the extra liquid toner, so that thickness of a liquid toner layer is uniformized and thereby a liquid toner supply to the surface of the developing roller, i.e. a liquid toner supply to upstream side of the region of contact between the surfaces of the anilox roller and the developing roller is regulated.

Anilox roller is a metal cylinder whose surface is formed with cells by corrosion or a machine sculpture and afterward plated with hard chrome or coated with ceramics to raise wear resistance of the surface.

A regulation roller blade to scrape the extra liquid toner from the surface of the anilox roller is a thin metal blade contacting on the surface of the anilox roller Therefore, the regulation blade is worn early. When the regulation blade is worn, on the surface of the anilox roller, a linear scratch may occur by the worn regulation blade. An unevenness occurs to the liquid toner to be supplied to the surface of the developing roller because of the linear scratch, so that the electrostatic latent image on the surface of the photoconductor drum cannot be developed definitely, hence the worn regulation blade is changed. In other words, the regulation blade is expendable supplies.

In addition, the regulation blade is adjusted to uniformly contact on the surface of the anilox roller so that thickness of the liquid toner layer on the surface of the anilox roller is uniformized. For example, an edge (ridge line) of the tip of the regulation blade is adjusted to be accurately pressed to the predetermined position of the surface of the anilox roller by uniform power.

The developing roller of the wet type developing device which comprises the anilox roller and the developing roller is as follows.

The liquid toner layer of uniform thickness is formed on the surface of the developing roller with the liquid toner supplied by the anilox roller. The liquid toner of this liquid toner layer is transferred to an electrostatic latent image on the surface of the photoconductor drum and develops the electrostatic latent image.

At this time the liquid toner which was not transferred to the electrostatic latent image on the surface of the photoconductor drum is left on the surface of the developing roller as a residual liquid toner. Therefore, a history of the electrostatic latent image is left on the surface of the developing roller. In other words, one part with the liquid toner and the other part with no liquid toner occur on the surface of the developing roller. This history of the electrostatic latent image will be an obstacle to the formation of the liquid toner layer of uniform thickness before developing on the surface of the developing roller.

Therefore, the history of the electrostatic latent image is erased by bringing a cleaning blade into contact with the surface of the developing roller and scraping the residual liquid toner off the surface with the cleaning blade after transferring the liquid toner from the developing roller to the photoconductor drum.

The developing roller is a metal cylinder whose surface is coated with a rubber having elasticity and electrical conductivity. Therefore, a cleaning blade to scrape a residual liquid toner off the surface of the developing roller is made of urethane. For example, the cleaning blade is made with a metal plate whose tip an urethane board is bonded to.

However, the surface of the developing roller may be damaged by abrasion of the cleaning blade in itself even though the cleaning blade is made of urethane. Because the electrostatic latent image on the surface of the photoconductor drum cannot be definitely developed where the surface of the developing roller is damaged, the worn cleaning blade is changed. In other words, the cleaning blade is expendable supplies.

In addition, the cleaning blade is adjusted to uniformly contact on the surface of the developing roller so as to surely scrape off the residual liquid toner on the surface of the developing roller. For example, an edge of the tip of the cleaning blade is adjusted to be accurately pressed to the predetermined position of the surface of the developing roller.

As described above, the conventional wet type developing device comprises the regulation blade to regulate a liquid toner supply by the anilox roller to upstream side of the region of contact between the surfaces of the anilox roller and the developing roller and the cleaning blade to erase a history of the electrostatic latent image on the surface of the developing roller.

Because both the regulation blade and cleaning blade are worn early and damage the surfaces of the anilox roller and the developing roller, respectively by being worn, it is necessary to change them frequently.

Therefore, since it is necessary to produce a lot of two kinds of blades different in use, material and shape and to keep them, the production cost of the blades is high, and the safekeeping of the blades is troublesome.

In addition, the regulation blade is adjusted to uniformly contact on the surface of the anilox roller and the cleaning blade is adjusted to uniformly contact on the surface of the developing roller.

Therefore, these two blades must be separately adjusted, and these adjustment works of the blades are troublesome because these adjustment works are difficult.

In addition, given a deflection of the regulation blade, the holder to attach the regulation blade becomes a thick and big part, and thus the compactification of the device is difficult.

Further, the cleaning blade may not erase the history of the electrostatic latent image on the surface of the developing roller surely due to a phenomenon called caking that a highly-concentrated liquid toner coagulates on the cleaning blade separately from abrasion of the cleaning blade in itself.

Furthermore, the developing roller and the cleaning blade are strictly required to have a smoothness of the surface of the developing roller and a straightness of the edge of the cleaning blade, respectively in order to surely erase the history of the electrostatic latent image on the surface of the developing roller.

Therefore, a high formation technology and an abrasion technology are necessary for the production of the developing roller and the cleaning blade and, as a result, lead to an increase in cost.

In addition, a nip pool of liquid toner (a state that liquid toners are collected) may occur in a portion on the anilox roller upstream of the part in which the surfaces of the anilox roller and the developing roller are in contact with one another even though the regulation blade and the cleaning blade are accurately exactly adjusted as described above. In this case, the quantity of the liquid toner on the surface of the developing roller before the final developing will be fixed after the surface of the anilox roller comes in contact with the surface of the developing roller, but the supply precision of appropriate and uniform amount of the liquid toner to the surface of the developing roller may decrease gradually while a liquid toner adheres and deposits in the cell of the anilox roller.

In view of the problems mentioned above, it is an object of the present invention to provide a wet type developing device whereby the regulation of a liquid toner supply by the anilox roller to upstream side of the region of contact between the surfaces of the anilox roller and the developing roller and the erasure of a history of the electrostatic latent image on the surface of the developing roller can be performed with the same roller, the surfaces of the anilox roller and the developing roller are not injured even though the roller is worn, the production cost of the roller is low, the safekeeping of the roller is easy, the adjustment work of the roller is easy, and the production of the developing roller is easy.

DISCLOSURE OF THE INVENTION

The present invention relates to the first to the fourth wet type developing device.

The first wet type developing device;

a wet type developing device comprising a developing roller being in contact with a surface of a photoconductor drum and an anilox roller being in contact with a surface of the developing roller and having a surface in part immersed in a liquid toner whereby an electrostatic latent image formed on the surface of the photoconductor drum is developed with the liquid toner supplied to the surface of the developing roller from the anilox roller, the wet type developing device further comprises:

a dual purpose roller being opposite to the surface of the anilox roller, leaving a gap therebetween, upstream of a region of contact between the surfaces of the anilox roller and the developing roller and being in contact with the surface of the developing roller upstream of the region of contact between the surfaces of the anilox roller and the developing roller and being rotationally driven, wherein a surface part of the dual purpose roller consists of a porous member which has flexibility and elasticity.

The second wet type developing device;

a wet type developing device comprising a developing roller being in contact with a surface of a photoconductor drum and an anilox roller being in contact with a surface of the developing roller and having a surface in part immersed in a liquid toner whereby an electrostatic latent image formed on the surface of the photoconductor drum is developed with the liquid toner supplied to the surface of the developing roller from the anilox roller, the wet type developing device further comprises:

a dual purpose roller being in contact with the surface of the anilox roller upstream of a region of contact between the surfaces of the anilox roller and the developing roller and being in contact with the surface of the developing roller upstream of the region of contact between the surfaces of the anilox roller and the developing roller and being rotationally driven, wherein a surface part of the dual purpose roller consists of a porous member which has flexibility and elasticity.

The third wet type developing device;

a wet type developing device comprising a developing roller being in contact with a surface of a photoconductor drum and an anilox roller being in contact with a surface of the developing roller and having a surface in part immersed in a liquid toner whereby an electrostatic latent image formed on the surface of the photoconductor drum is developed with the liquid toner supplied to the surface of the developing roller from the anilox roller, the wet type developing device further comprises:

a dual purpose roller being opposite to the surface of the anilox roller, leaving a gap therebetween, upstream of a region of contact between the surfaces of the anilox roller and the developing roller and being in contact with the surface of the developing roller upstream of the region of contact between the surfaces of the anilox roller and the developing roller and being at a standstill, wherein a surface part of the dual purpose roller consists of a porous member which has flexibility and elasticity.

The fourth wet type developing device;

a wet type developing device comprising a developing roller being in contact with a surface of a photoconductor drum and an anilox roller being in contact with a surface of the developing roller and having a surface in part immersed in a liquid toner whereby an electrostatic latent image formed on the surface of the photoconductor drum is developed with the liquid toner supplied to the surface of the developing roller from the anilox roller, characterized in that the wet type developing device further comprises:

a dual purpose roller being in contact with the surface of the anilox roller upstream of a region of contact between the surfaces of the anilox roller and the developing roller and being in contact with the surface of the developing roller upstream of the region of contact between the surfaces of the anilox roller and the developing roller and being at a standstill, wherein a surface part of the dual purpose roller consists of a porous member which has flexibility and elasticity.

In the first, the third wet type developing device, the device further comprises a gap adjustment mechanism to adjust the size of a gap between the surface of the anilox roller and the surface of the dual purpose roller.

In this way, a predetermined quantity of the liquid toner can be supplied from the anilox roller to the surface of the developing roller by adjusting the gap between the surface of the anilox roller and the surface of the dual purpose roller to a predetermined value.

In the second, the fourth wet type developing device, the device further comprises a nip width adjustment mechanism to adjust a nip width between the surface of the anilox roller and the surface of the dual purpose roller.

In this way, a predetermined quantity of the liquid toner can be supplied from the anilox roller to the surface of the developing roller by adjusting the nip width between the surface of the anilox roller and the surface of the dual purpose roller to a predetermined value.

In the first, the second, the third, the fourth wet type developing device, the porous member which composes the surface part of the dual purpose roller and has flexibility and elasticity is a sponge of open cell foam.

In this way, a performance of the dual purpose roller to erase the history of the electrostatic latent image on the surface of the developing roller can be superior.

In the first, the second, the third, the fourth wet type developing device, the porous member which composes the surface part of the dual purpose roller and has flexibility and elasticity is a sponge of closed cell foam.

In this way, a start performance of the wet type developing device can be superior.

In each of the wet type developing devices, a difference between a circumferential speed of the anilox roller and a circumferential speed of the developing roller is made.

In this way, a quantity of the liquid toner to move to the surface of developing roller from the surface of the anilox roller can be increased or decreased.

In the first, the second wet type developing device, the dual purpose roller rotates in the same direction as the developing roller and thereby the surface of the dual purpose roller moves in a direction opposite to a movement direction of the surface of the developing roller in the region of contact with the surface of developing roller rubbing with each other.

In this way, a performance of the dual purpose roller to erase the history of the electrostatic latent image on the surface of the developing roller can be improved.

In the first, the second wet type developing device, a circumferential speed of the dual purpose roller is slower than a circumferential speed of the anilox roller.

In this way, a performance of the anilox roller to control the liquid toner supply to the upstream side of the region of contact between the surface of the developing roller and the surface of the anilox roller can be improved.

In each of the wet type developing devices, the device further comprises a liquid toner supply control member to coarsely adjust a liquid toner supply to upstream side of a dual purpose roller contacting portion or a dual purpose roller opposing region on the surface of the anilox roller.

In this way, the regulation of the liquid toner on the surface of the anilox roller with the dual purpose roller can be efficiently performed.

In the first, the second wet type developing device, the device further comprises a liquid toner recovery member being disposed to be pressed against the surface of the dual purpose roller between upstream side of an anilox roller contacting portion or an anilox roller opposing portion and downstream side of a developing roller contact portion.

In this way, because the liquid toner is repeatedly absorbed in and discharged from the surface part of the dual purpose roller, it is prevented that the liquid toner adheres in the surface part of the dual purpose roller and the ability for adsorption of the residual liquid toner of the sponge of the surface part can be maintained for a long term.

In each of the wet type developing devices, the device further comprises a liquid toner discharge member for discharging, a surplus liquid toner in a nip beginning region upstream of the region of contact between the surfaces of the anilox roller and the developing roller, into the liquid toner tank.

In this way, because a surplus liquid toner in a nip beginning region upstream of the region of contact between the surfaces of the anilox roller and the developing roller is discharged into the liquid toner tank, there is nothing adversely affecting the electrophotographic print on the ground that the liquid toner runs down to an area around the wet type developing device.

According to the first, the second, the third, the fourth wet type developing device of the present invention, the regulation of a liquid toner supply by the anilox roller to the upstream of the region of contact between the surface of the developing roller and the surface of the anilox roller and the erasure of a history of the electrostatic latent image on the surface of the developing roller can be performed with one dual purpose roller.

Therefore, only one kind of roller have to be produced and thus the production cost of the roller is low and the safekeeping of the roller is easy.

In addition, since the surface part of the dual purpose roller consists of a porous member having flexibility and elasticity, the surfaces of the anilox roller and the developing roller are not injured even though the roller is worn.

Further, it is not necessary to put the dual purpose roller on the predetermined positions of the surfaces of the anilox roller and the developing roller accurately, and thereby adjustment work of the dual purpose roller is easy.

Furthermore, since the erasure of the history of the electrostatic latent image on the surface of the developing roller is performed by bringing the dual purpose roller into contact with the surface of the developing roller, the smoothness of the surface of the developing roller is not strictly required, and thereby production of the developing roller is easy and conductive to a reduction in cost.

According to the second wet type developing device of the present invention, the supply precision of appropriate and uniform amount of the liquid toner to the surface of the developing roller does not decrease because the liquid toner does not adhere and deposit in the cell of the anilox roller.

PREFERRED EMBODIMENT OF THE PRESENT INVENTION

An embodiment of the electrographic printer using the wet type developing device of the present invention will be described with reference to FIG. 1 as an example.

Figure 1:
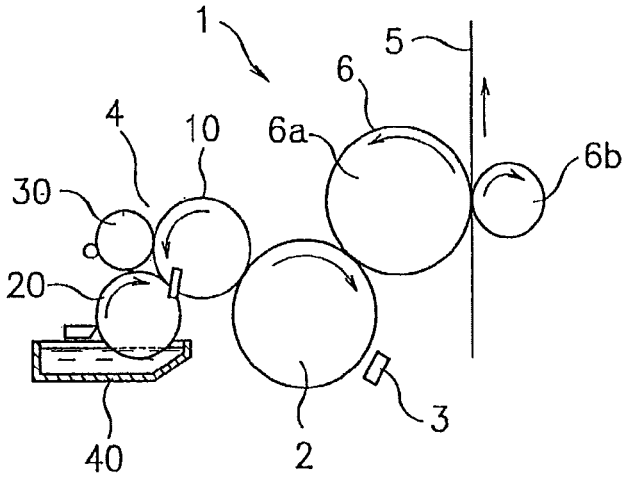
FIG. 1 is a schematic explanatory view of the electrographic printer using the wet type developing device of the present invention.

FIG. 1 is a schematic explanatory view of the electrographic printer.

The electrographic printer 1 comprises a photoconductor drum 2, a latent image forming device 3 forming an electrostatic latent image on a surface of the photoconductor drum 2, a wet type developing device 4 of the present invention developing an electrostatic latent image on the surface of the photoconductor drum 2 with a liquid toner and a transfer device 6 transferring a liquid toner image developed on the surface of the photoconductor drum 2 to a transfer paper 5 or the like.

The transfer device 6 has a transfer roller 6*a* rotationally driven while being in contact with the surface of the photoconductor drum 2 and an impression cylinder 6*b* rotationally driven while being in contact with a surface of the transfer roller 6*a* through the transfer paper 5.

And the liquid toner image developed on the surface of the photoconductor drum 2 is transferred to the surface of the transfer roller 6*a*. The liquid toner image transferred to the transfer roller 6*a* is transferred to the transfer paper 5 in a contact portion between the transfer roller 6*a* and the impression cylinder 6*b*. Structure of the transfer device is not limited to the transfer device 6, other structure conventionally known may be adopted for the transfer device 6.

Figure 2:
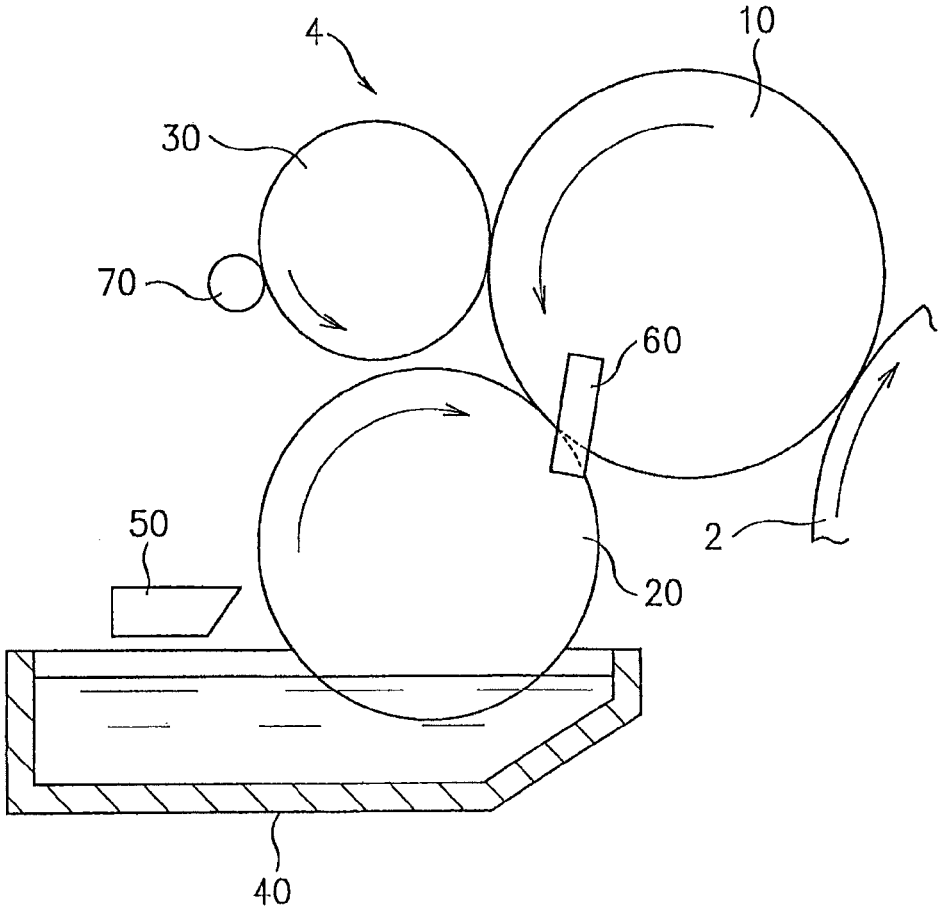
FIG. 2 is a schematic structural explanatory view illustrating a first embodiment of the wet type developing device of the present invention.

A first embodiment of the wet type developing device 4 of the present invention will be explained based on FIG. 2. FIG. 2 is a schematic structural explanatory view of the wet type developing device.

The wet type developing device 4 comprises a developing roller 10, an anilox roller 20 in contact with a surface of the developing roller 10, a dual purpose roller 30, a liquid toner tank (liquid boat) 40, a liquid toner supply control member (coarsely adjusting member) 50, a liquid toner discharge member 60 and a liquid toner recovery member 70 or the like.

The developing roller 10 has the surface coming in contact with the surface of the photoconductor drum 2 as with the developing roller of the conventional wet type developing device and is rotationally driven in the direction opposite to the rotational direction of the photoconductor drum 2, for example, counterclockwise at the time of developing operation.

Therefore, the surface of the developing roller 10 is moved in the same direction as the surface of the photoconductor drum 2 in the region of contact with the surface of the photoconductor drum 2 and in this way develops an electrostatic latent image on the surface of the photoconductor drum 2. In other words, the developing roller 10 is in rotational contact with the surface of the photoconductor drum 2 at the time of developing operation.

The anilox roller 20 is in contact with the surface of the developing roller 10 and has a surface in part immersed in a liquid toner in the liquid toner tank 40 as with the anilox roller of the conventional wet type developing device. The anilox roller 20 is rotationally driven in the direction opposite to the rotational direction of the developing roller 10, for example, clockwise at the time of developing operation. Therefore, the surface of the anilox roller 20 is moved in the same direction as the surface of the developing roller 10 in the region of contact with the surface of the developing roller 10, and the anilox roller 20 conveys the liquid toner filled in the cells and supplies it to the surface of the developing roller 10, and thereby a liquid toner layer is formed on the surface of the developing roller 10. In other words, the anilox roller 20 is in rotational contact with the surface of the developing roller 10 at the time of developing operation.

The quantity of the liquid toner to move from the surface of the anilox roller 20 to the surface of developing roller 10 can be increased or decreased by making a difference between a circumferential speed of the anilox roller 20 and a circumferential speed of the developing roller 10. In other words, the quantity of the liquid toner to move is increased by making the circumferential speed of the anilox roller 20 faster than the circumferential speed of developing roller 10, and the quantity of the liquid toner to move is decreased by making the circumferential speed of the anilox roller 20 slower than the circumferential speed of developing roller 10.

The surface part of the dual purpose roller 30 consists of the porous member which has flexibility and elasticity. The surface of the dual purpose roller 30 is opposite to the surface of the anilox roller 20, leaving a gap therebetween, upstream of the region of contact between the surfaces of the anilox roller 20 and the developing roller 10. The dual purpose roller 30 is rotationally driven in the opposite direction to the rotational direction of the anilox roller 20, e.g., the counterclockwise at the time of developing operation.

Therefore, the surface of the dual purpose roller 30 is moved in the same direction as the surface of the anilox roller 20 leaving a gap therebetween, in the region opposite to the anilox roller 20, and the dual purpose roller 30 regulates a quantity of the liquid toner supplied by the anilox roller 20 to upstream side of the region of contact between the surfaces of the anilox roller 20 and the developing roller 10, i.e. a quantity of the liquid toner supply to upstream side of the region of contact between the surfaces of the anilox roller 20 and the developing roller 10. In this way, the dual purpose roller 30 can regulate the quantity of the liquid toner on the surface of the developing roller 10 after contact with the anilox roller 20 before the developing.

The dual purpose roller 30 has the surface coming in contact with the surface of the developing roller 10 upstream of the region of contact between the surfaces of the anilox roller 20 and the developing roller 10 and is rotationally driven in the same direction as the developing roller 10, for example, counterclockwise at the time of developing operation. In other words, the dual purpose roller 30 is in rotational contact with the surface of the developing roller 10 at the time of developing operation.

Therefore, the surface of the dual purpose roller 30 is moved in the direction opposite to the moving direction of the surface of the developing roller 10 in the region of contact with the surface of developing roller 10 rubbing with each other and scatters the residual liquid toners which remained on the surface of developing roller 10 after the developing on the surface of developing roller 10 uniformly and shake them off the surface of the developing roller 10, and in this way erase the history of the electrostatic latent image on the surface of the developing roller 10.

As for circumferential speeds of the developing roller 10, the anilox roller 20 and the dual purpose roller 30, where the circumferential speed of the developing roller 10 is 100%, that of the anilox roller 30 should be in the range of 10~200% and that of the dual purpose roller should be in the range of 0~100%. These circumferential speeds are changed mainly depending on the kind of the liquid toner.

The circumferential speed of the dual purpose roller 30 is set to be slower than the circumferential speed of the anilox roller 20.

The liquid toner supply control member 50 is disposed opposite to the surface of the anilox roller 20 upstream of a dual purpose roller 30 opposing region where the dual purpose roller 30 is opposite to the surface of the anilox roller 20.

The liquid toner supply control member 50 coarsely adjusts a quantity of the liquid toner on the surface of the anilox roller 20 and thereby adjusts a liquid toner supply to the dual purpose roller opposing region.

The liquid toner supply control member 50 shown in FIG. 2 is a plate opposite to the surface of the anilox roller 20 leaving a gap therebetween. The liquid toner supply control member is not limited to the liquid toner supply control member 50, it may be a roller which is disposed in contact with the surface of the anilox roller 20.

The liquid toner discharge member 60 discharges a surplus liquid toner in a nip beginning region (contact starting part) upstream of the region of contact between the surfaces of the anilox roller 20 and the developing roller 10, to the liquid toner tank 40.

The liquid toner discharge member 60 shown in FIG. 2 is side doctor blades which are disposed opposite to both axial end surfaces of the developing roller 10 and both axial end surfaces of the anilox roller 20, respectively. The liquid toner discharge member is not limited to the liquid toner discharge member 60, it may be one of two plates which are in contact with and over both axial ends of the surface of the developing roller 10 and both axial ends of the surface of the anilox roller 20, respectively. In addition, the liquid toner discharged by the liquid toner discharge member 60 flows down to the liquid toner tank 40.

The liquid toner recovery member 70 is disposed to be pressed against the surface of the dual purpose roller 30 between upstream side of an anilox roller opposing region at which it is opposite to the surface of the anilox roller 20 and downstream side of a developing roller contact position at which it is in contact with the surface of the developing roller 10.

The liquid toner recovery member 70 recovers the liquid toner from the dual purpose roller 30 by letting the surface part of the dual purpose roller 30 discharge the liquid toner absorbed in its surface part.

The liquid toner recovery member 70 shown in FIG. 2 is an elongated rotatable rod-like body (round shaft) which has circular cross-section and is disposed to be pressed against the surface of the dual purpose roller 30. This shaft may be rotated in the same direction as the dual purpose roller 30 and may be rotated in the opposite direction. In addition, the shaft may be pressed against the surface of the dual purpose roller 30 in the state that it is at a standstill without rotating.

The liquid toner recovery member 70 may be a blade which is disposed to be pressed against the surface of the dual purpose roller 30.

In this way, as for the wet type developing device 4 shown in FIG. 2, because the regulation of the liquid toner supply by the anilox roller 20 to upstream side of the region of contact between the surfaces of the anilox roller 20 and the developing roller 10 and the erasure of the history of the electrostatic latent image on the surface of the developing roller 10 are carried out by one dual purpose roller 30, only one kind of roller have to be produced and prepared without production and preparation of the regulation blades and the cleaning blades that are different in use, material and shape as in conventional devices.

Therefore, the production cost of the roller is low and the safekeeping of the roller is easy.

In addition, because the surface part of the dual purpose roller 30 is formed of a porous member having flexibility and elasticity and the surface of the dual purpose roller 30 is not in contact with the surface of the anilox roller 20, a linear scratch does not occur on the surface of the anilox roller 20 even though the dual purpose roller 30 is worn.

In addition, since the surface part of the dual purpose roller 30 is formed of a porous member having flexibility and elasticity, it does not occur that residual liquid toners on the surface of the developing roller 10 cannot be scattered enough and not swept off and a linear scratch occurs on the surface of the developing roller 10 because of a little abrasion and a small wound of the dual purpose roller 30 itself.

In addition, since the surface part of the dual purpose roller 30 is formed of a porous member having flexibility and elasticity, it is not necessary to put the dual purpose roller 30 on the predetermined position of the surface of the developing roller 10 accurately in comparison with the conventional cleaning blade consisting of urethane boards, and thereby adjustment work of the dual purpose roller 30 is easy.

In addition, since the erasure of the history of the electrostatic latent image on the surface of the developing roller 10 is performed by bringing the dual purpose roller 30 into contact with the surface of the developing roller 10, the smoothness of the surface of the developing roller 10 is not required severer than the case that a conventional cleaning blade is used, and thereby production of the developing roller 10 is easy and conductive to a reduction in cost.

Then, the dual purpose roller 30 will be explained in detail.

The dual purpose roller 30 consists of a metal core and a porous member having flexibility and elasticity coating a peripheral surface of the metal core. In this way, the surface part of the dual purpose roller 30 consists of a porous member having flexibility and elasticity.

The porous member is a member including pores (cells) inside thereof, and there are two kinds of members, i.e. one is an open cell foam having a plurality of consecutive pores (cells) and the other is a closed cell foam having a plurality of independent pores (cells).

As a porous member having flexibility and elasticity, there are a sponge made of the open cell foam and a sponge made of the closed cell foam.

The sponge of open cell foam is superior in water absorptivity and breathability and its repulsion elasticity is small because the internal cells are consecutive and thereby a liquid and a gas infiltrate the internal cells.

In the sponge of the closed cell foam, a liquid and a gas do not infiltrate the internal pores thereof because the internal pores are independent, but the sponge has liquid water absorptivity and gaseous breathability caused by the surface pores thereof and is superior in the repulsion elasticity.

Either the sponge of open cell foam or the sponge of the closed cell foam can be used to erase the history of the electrostatic latent image on the surface of the developing roller 10.

However, the sponge of open cell foam is superior to the sponge of the closed cell foam in performance to erase the history of the electrostatic latent image with the residual liquid toner because the sponge of open cell foam takes and discharges more residual liquid toner than the sponge of the closed cell foam under the equal conditions of use. Preferably the sponge of open cell foam of 75-90% of porosity is good.

But the sponge of open cell foam takes a long time before being stable because it becomes stable by internal pores (cells) absorbing a liquid toner, and being saturated. On the contrary, the sponge of the closed cell foam takes a short time before being stable because it becomes stable by the surface pores (cells) absorbing a liquid toner. Therefore, the sponge of the closed cell foam can make the developing operation start in a shorter time than the sponge of open cell foam and is superior thereto in enhancing the start performance of the wet type developing device.

In the wet type developing device 4 shown in FIG. 2, bias voltages are applied to the developing roller 10 and the anilox roller 20, respectively. A film of the uniform liquid toner layer is formed on the surface of the developing roller 10 by controlling voltage value of the bias voltage of each of the rollers appropriately.

The bias voltage to be applied to the developing roller 10 is +200~+1,000V.

The bias voltage to be applied to the anilox roller 20 is +200~+1,000V.

In addition, the wet type developing device 4 shown in FIG. 2 has a developing charger (not shown) disposed upstream of the region of contact between the developing roller 10 and the surface of the photoconductor drum 2. A positive electric charge is applied to the surface of the developing roller 10 by this developing charger. In this way, an effect to add a positive electric potential to a liquid toner is generated by charging the positive electric potential to the liquid toner from the outside of developing roller 10 and an effect to push the liquid toner to the surface of the developing roller 10 is generated by applying the positive electric potential from the outside of the developing roller 10.

By these effects, liquid toner particles clumps together on the surface of the developing roller 10, and, as a result, the developing of the electrostatic latent image on the surface of the photoconductor drum 2 is performed well.

The applied electric current by the developing charger is +600~+3,600 μA.

In addition, the wet type developing device 4 shown in FIG. 2 has a developing minus charger (not shown) disposed downstream of the region of contact between the developing roller 10 and the surface of the photoconductor drum 2. A negative electric charge is applied to the surface of the developing roller 10 by this developing minus charger. In this way, an effect to let the liquid toner on the surface of the developing roller 10 float.

Therefore, a residual liquid toner on the surface of the developing roller 10 is liberated from the surface of the developing roller 10 by applying the negative electric charge to a part after the developing in the surface of the developing roller 10 with the developing minus charger, and thereby the residual liquid toner on the surface of the developing roller 10 becomes easy to be removed with the dual purpose roller 30.

The applied electric current by the developing minus charger is −300~−1800 μA.

Then, an action of the dual purpose roller 30 on the anilox roller 20 will be explained in detail.

The liquid toner attaches in laminae to the part which appeared from a liquid toner of the liquid toner tank 40 in the surface of the anilox roller 20 and moves to the liquid toner supply control member 50 by rotation of the anilox roller 20. And, the liquid toner which attached in laminae to the surface of the anilox roller 20 is coarsely adjusted into the liquid toner layer of the predetermined thickness by the liquid toner supply control member 50. The thickness of this coarsely adjusted liquid toner layer is bigger than a gap between the surface of the anilox roller 20 and the surface of the dual purpose roller 30.

The coarsely adjusted liquid toner layer touches the dual purpose roller 30 by further rotation of the anilox roller 20, and thereby the thickness of the liquid toner layer of the surface of the anilox roller 20 is regulated by the dual purpose roller 30, so that a thin liquid toner layer is formed on the surface of the anilox roller 20 with the liquid toner which overflowed from the cell, as the result the quantity of the liquid toner on the surface of the anilox roller 20 is regulated. And the thin liquid toner layer on the surface of the anilox roller 20 is moved to the region of contact between the surface of the developing roller 10 and the surface of the anilox roller 20.

In this way, a liquid toner supply by the anilox roller 20 to upstream side of the region of contact between the surface of the developing roller 10 and the surface of the anilox roller 20 can be regulated.

In other words, the gap between the surface of the anilox roller 20 and the surface of the dual purpose roller 30 is the approximately same as the thickness of the liquid toner layer to be regulated.

In addition, since the quantity of the liquid toner on the surface of the anilox roller 20 is coarsely adjusted by the liquid toner supply control member 50, and then the quantity of the liquid toner on the surface of the anilox roller 20 is regulated by the dual purpose roller 30, the regulation of the quantity of the liquid toner can be efficiently performed.

When the quantity of liquid toner on the surface of the anilox roller 20 is regulated by the dual purpose roller 30, in the case where the dual purpose roller 30 is coated with the sponge of the closed cell foam, the liquid toner is absorbed into the surface pores (cells) until the surface pore of the sponge are saturated with the liquid toner, and the liquid toner is no longer absorbed any more if the surface pores are saturated with the liquid toner.

In the case where the dual purpose roller 30 is coated with the sponge of open cell foam, the liquid toner is absorbed into the internal cells (pores) until the internal pores of the sponge are saturated with the liquid toner, and the liquid toner is no longer absorbed any more if the internal pores are saturated with the liquid toner.

As for the wet type developing device 4 shown in FIG. 2, since it has the liquid toner recovery member 70, in either the sponge of the closed cell foam or the sponge of the open cell foam, the liquid toner which collected in the pores of the sponge is discharged, and after this, the pores which discharged the liquid toner come in contact with the liquid toner on the surface of the anilox roller 20, and the pores in the part absorb the liquid toner until they are saturated. In the case of a wet type developing device without the liquid toner recovery member 70, since the pores of the sponge are saturated with the liquid toner in either the sponge of the closed cell foam or the sponge of open cell foam, the pores of the sponge in a part opposite to the surface of the anilox roller 20 do not absorb the liquid toner at all.

Therefore, the regulation of the quantity of the liquid toner on the surface of the anilox roller 20 with the dual purpose roller 30 is not caused by absorption of the liquid toner by the sponge of the closed cell foam or the sponge of open cell foam which constitutes the surface part of the dual purpose roller 30, but by damming up a part of the liquid toner on the surface of the anilox roller 20 by the sponge of the closed cell foam or the sponge of open cell foam, so that the quantity of the liquid toner on the surface of the anilox roller 20 is regulated.

In other words, the thickness of the liquid toner layer becomes thin by a surface-near part of the liquid toner layer on the surface of the anilox roller 20 touching the surface of the dual purpose roller 30, so that the quantity of the liquid toner on the surface of the anilox roller 20 is regulated.

Therefore, the quantity of the liquid toner on the surface of the anilox roller 20 can be increased and decreased by adjusting the size of the gap between the surface of the anilox roller 20 and the surface of the dual purpose roller 30.

As for the wet type developing device 4 shown in FIG. 2, since the surface part of the dual purpose roller 30 consists of the porous member having flexibility and elasticity and the dual purpose roller 30 does not come in contact with the surface of the anilox roller 20, the abrasion of the dual purpose roller 30 is controlled and the surface of the anilox roller 20 is not damaged.

In the part of the dual purpose roller 30, where the quantity of the liquid toner on the surface of the anilox roller 20 is regulated, the pores of the sponge of the closed cell foam or the sponge of open cell foam is saturated with the liquid toner. Because the part comes in contact with the surface of the developing roller 10 downstream in the rotational direction of the dual purpose roller 30 and thereby the sponge of the closed cell foam or open cell foam of the part is compressed, the liquid toner in the pores of the sponge of the closed cell foam or the sponge of open cell foam is discharged onto the surface of the developing roller 10 at the nip beginning region (contact start part) upstream of the region of contact therebetween. The discharged liquid toner moves to the nip beginning region (contact start part) upstream of the region of contact between the surface of the developing roller 10 and the surface of the anilox roller 20.

As a result, in the nip beginning region (contact start part) upstream of the region of contact between the surface of the developing roller 10 and the surface of the anilox roller 20, a nip pool of the liquid toner (the state that the liquid toner is collected upstream of the region of contact between the surface of the developing roller 10 and the surface of the anilox roller 20) occurs.

In addition, when the quantity of the liquid toner on the surface of the anilox roller 20 increases more than predetermined amount, a nip pool of the liquid toner also occurs in the nip beginning region (contact start part) upstream of the region of contact between the surface of the developing roller 10 and the surface of the anilox roller 20.

In this way, when the liquid toner is discharged from the pores of the sponge of the dual purpose roller 30 onto the surface of the developing roller 10 by the surface of the dual purpose roller 30 coming in contact with the surface of the developing roller 10 or the quantity of the liquid toner on the surface of the anilox roller 20 increases more than predetermined amount, only a nip pool of the liquid toner occurs (comes into existance) in the nip beginning region (contact start part) upstream of the region of contact between the surface of the developing roller 10 and the surface of the anilox roller 20, but is not led to an increase of the quantity of the liquid toner to be supplied to the surface of the developing roller 10.

In other words, if the nip width (contact width) between the surface of the developing roller 10 and the surface of the anilox roller 20 is not changed and constant, the liquid toner discharged from the dual purpose roller 30 onto the surface of the developing roller 10 and the liquid toner increased on the surface of the anilox roller 20 are pooled as a surplus liquid toner in the nip beginning region upstream of the region of contact between the surface of the developing roller 10 and the surface of the anilox roller 20 and only a nip pool of the liquid toner occurs, but the quantity of the liquid toner to be supplied to the surface of the developing roller 10 does not increase. An explanation about the nip width will be provided later.

The liquid toner in the nip pool of the liquid toner flows toward both axial ends of the developing roller 10 and the anilox roller 20 as a surplus liquid toner and flows into the liquid toner tank 40 along the liquid toner discharge member 60.

Therefore, there is nothing adversely affecting the electrophotographic print on the ground that the liquid toner in the nip pool of the liquid toner runs down to an area around the wet type developing device 4 without attaching thereto.

Next, an action of the dual purpose roller 30 on the developing roller 10 will be explained in detail.

Because the dual purpose roller 30 rotates in the direction same as the developing roller 10 and thereby the surface of the dual purpose roller 30 and the surface of the developing roller 10 is moved in the directions opposite to each other in the region of contact between the surface of the dual purpose roller 30 and the surface of the developing roller 10, the dual purpose roller 30 scatters the residual liquid toner on the surface of the developing roller 10 thereon efficiently uniformly and sweeps it off, and the residual liquid toner swept off is maintained on the surface of the dual purpose roller 30, and thereby it is removed from the surface of the developing roller 10.

Therefore, the performance to erase the history of the electrostatic latent image on the surface of the developing roller 10 with the dual purpose roller 30 improves.

In addition, the sponge of the closed cell foam or the sponge of open cell foam which is the surface part of the dual purpose roller 30 is compressed at the region of contact with the surface of the developing roller 10, thereby the liquid toner is discharged from the pores of the sponge to the surface of the developing roller 10 in the nip beginning region upstream of the region of contact, and thereafter the sponge expands and returns to its original state in a nip dissolving region downstream of the region of contact, thereby the residual liquid toner on the surface of the developing roller 10 is absorbed into the pores of the sponge.

Therefore, in this way, the performance of the dual purpose roller 30 to erase the history of the electrostatic latent image on the surface of the developing roller 10 improves, too.

That the surface of the dual purpose roller 30 come in contact with the surface of the developing roller 10 means to push the surface of the dual purpose roller 30 to the surface of the developing roller 10, and the force to push is a nip pressure. Width of the surface of the developing roller 10 in contact with the surface of the dual purpose roller 30 is determined by intensity of the nip pressure. The width to contact is the nip width.

And, the quantity of absorption of the liquid toner can be adjusted by adjusting the nip width.

The quantity of absorption of the liquid toner increases when the nip width is made wide (large).

The quantity of absorption of the liquid toner decreases when the nip width is made narrow (small).

Because the quantity of absorption of the liquid toner of the nip dissolving region downstream of the region of contact increases when the quantity of absorption of the liquid toner increases, the performance to erase the history of the electrostatic latent image on the surface of the developing roller 10 with the dual purpose roller 30 improves.

Because the sponge of open cell foam discharges and absorbs the more residual liquid toner than the sponge of the closed cell foam in case where use conditions of the dual purpose roller 30 are the same, the sponge of open cell foam is superior to the sponge of the closed cell foam in performance to erase the history of the electrostatic latent image with the residual liquid toner on the surface of the developing roller 10.

In addition, because the sponge of the closed cell foam takes the shorter time from absorbing of the liquid toner to being stable than the sponge of open cell foam, the sponge of the closed cell foam can start developing movement with taking less time than the sponge of open cell foam and is therefore superior in starting performance of the wet type developing device.

Next, an action of the liquid toner recovery member 70 will be explained.

Because the dual purpose roller 30 rotates while being pushed against the liquid toner recovery member 70 and thereby the liquid toner which collected in the pores of the sponge of open cell foam or the sponge of the closed cell foam of the dual purpose roller 30 is discharged, the liquid toner recovery member 70 can recover the liquid toner from the dual purpose roller 30.

After this, the pores of the dual purpose roller 30 which discharged the liquid toner come in contact with the liquid toner on the surface of the anilox roller 20, and the liquid toner is absorbed in the cells.

In this way, because the liquid toner is repeatedly absorbed in and discharged from the pores of the sponge of open cell foam or the sponge of the closed cell foam of the dual purpose roller 30, it is prevented that the liquid toner adheres in the pores and the ability for adsorption of the residual liquid toner of the sponge of open cell foam or the sponge of the closed cell foam can be maintained for a long term.

As for the wet type developing device 4 shown in FIG. 2, if the dual purpose roller 30 consists of the sponge of open cell foam, its porosity is preferably 75-90%, and the nip width between the surface of the developing roller 10 and the surface of the dual purpose roller 30 is preferably around 20 mm at a maximum.

Figure 3:
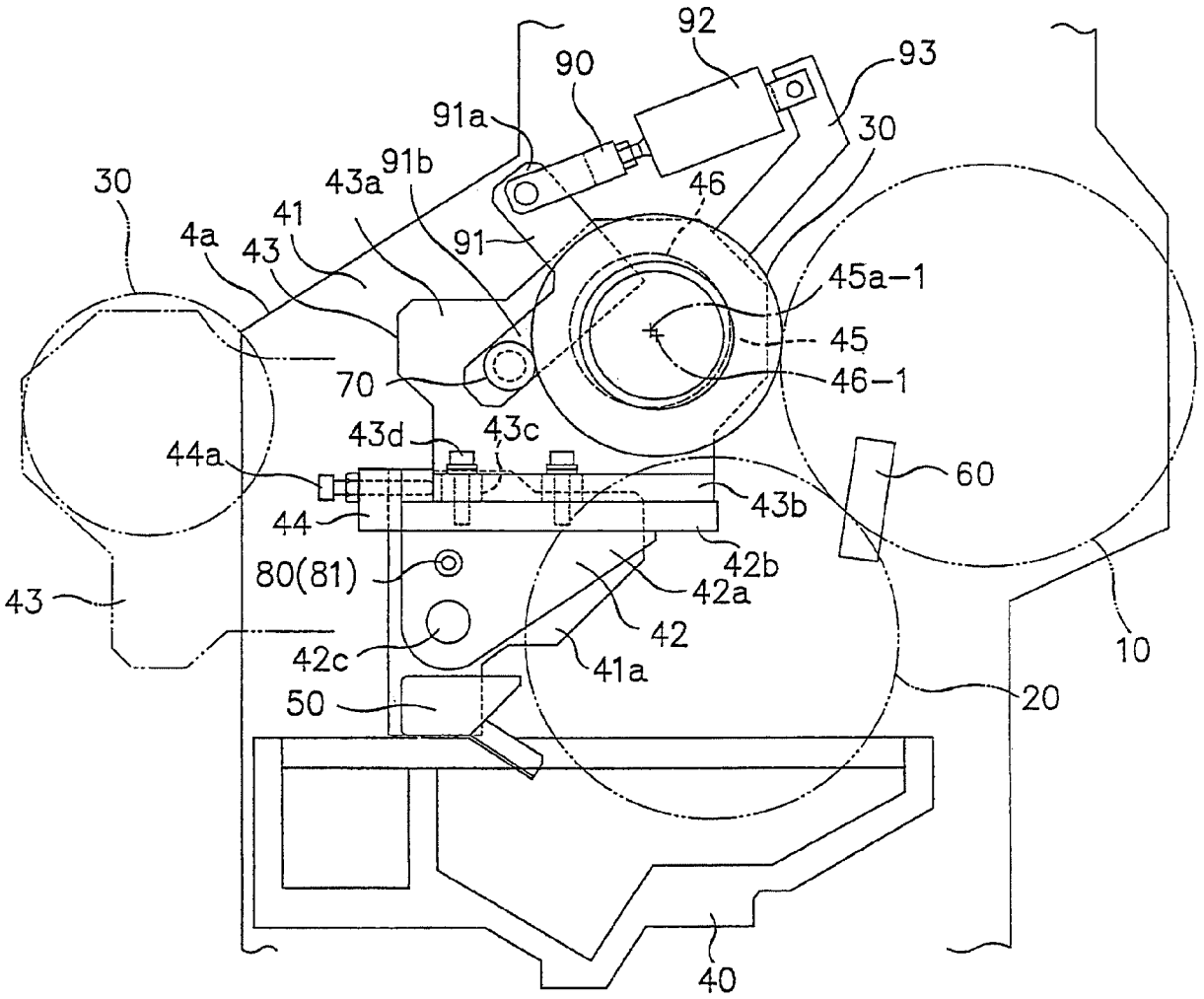
FIG. 3 is a vertical sectional view illustrating each of the attaching portions of the developing roller, anilox roller and the dual purpose roller.
Figure 4:
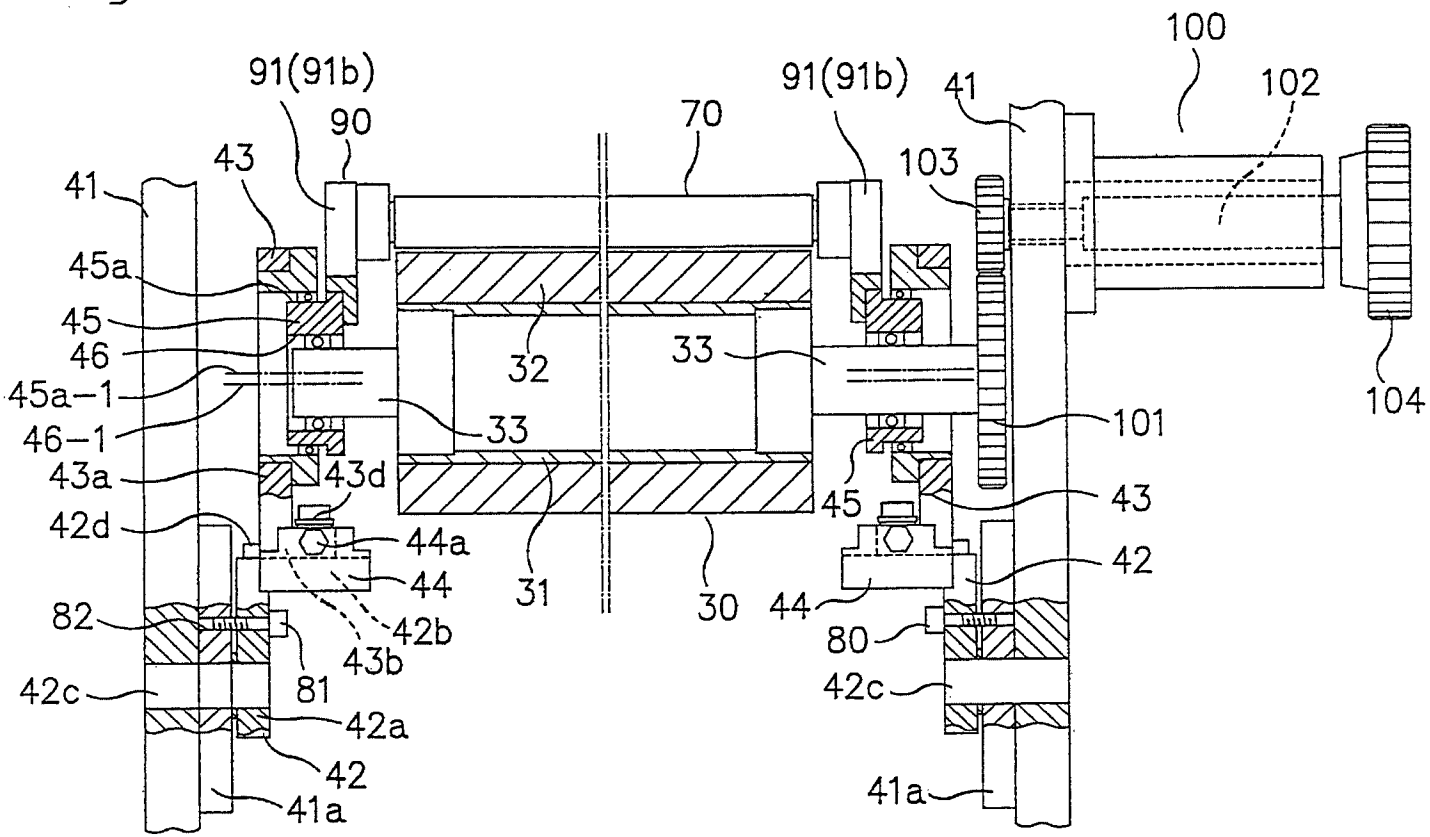
FIG. 4 is a transverse sectional view illustrating the attaching portion of the dual purpose roller.

Next, installations of the developing roller 10, the anilox roller 20 and the dual purpose roller 30 of the wet type developing device 4 will be illustrating based on FIGS. 3 and 4. FIG. 3 is a transverse sectional view illustrating attaching portions of the developing roller 10, the anilox roller 20 and the dual purpose roller 30, and FIG. 4 is a vertical sectional view indicating the attaching portion of the dual purpose roller 30.

The developing roller 10, the anilox roller 20, the dual purpose roller 30 and so forth of the wet type developing device 4 are attached to a main body of device 4*a*. The main body of device 4*a* has two vertical plate frames 41, 41 which are separated in the axial direction of each of the rollers.

The developing roller 10 and the anilox roller 20 are rotatably attached to the two frames 41, 41 therebetween. In addition, because the installation structures of the developing roller 10 and the anilox roller 20 are similar to the conventional structures, the explanations and the illustrations of the installation structures are omitted, and the developing roller 10 and the anilox roller 20 are illustrated in two-dot chain lines Turning frames 42, 42 which are opposite each other are respectively attached to internal surfaces of the frames 41, 41. Each turning frame 42 turns in a direction orthogonal to the axial direction of the developing roller 10, that is, in a direction approaching or leaving the developing roller 10 and turns to a developing operation position approaching to the developing roller 10 or a retreat position away from the developing roller 10.

The turning frame 42 is composed of a longitudinal part 42*a* vertically extended and a lateral part 42*b* continued to an upper end portion of the longitudinal part 42*a* and horizontally extended so as to be formed of a hook shape. The longitudinal part 42*a* is rotatably attached to the frame 41 with an axis 42*c*. The axis 42*c* is parallel to the axial direction of the rollers. In addition, a plate 41*a* is attached to the internal surface of the frame 41 and the axis 42*c* is disposed to penetrate the plate 41*a* and the frame 41.

A roller installation frame 43 is attached to the turning frame 42.

The dual purpose roller 30 is attached to the roller installation frame 43.

Therefore, the turning frame 42 turns around the axis 42*c* as a fulcrum in the direction getting closer to the developing roller 10 and then the roller installation frame 43 turns together with the turning frame 42 in the same direction. And, when the turning frame 42 turns to the developing operation position, the surface of the dual purpose roller 30 comes in contact with the surface of the developing roller 10.

In addition, the turning frame 42 turns around the axis 42*c* as a fulcrum in the direction spaced apart from the developing roller 10 and then the roller installation frame 43 turns together with the turning frame 42 in the same direction. And, when the turning frame 42 turns to the retreat position, the surface of the dual purpose roller 30 separates from the surface of the developing roller 10. In FIG. 3, the dual purpose roller 30 moves to the outside of a pair of frames 41, 41 as shown in two dot-chain lines.

Therefore, the inspection and maintenance of the dual purpose roller 30 can be easily performed by turning the turning frame 42 to the retreat position.

There is a locking mechanism 80 to lock the turning frame 42 at the developing operation position.

The locking mechanism 80 has a lock bolt 81 which is attached to the longitudinal part 42*a* of the turning frame 42. The turning frame 42 is locked at the developing operation position by screwing the lock bolt 81 in a screw hole 82 of the plate 41*a* and tightening it. Locking of the turning frame 42 is released by loosening the lock bolt 81 and pulling it out from the screw hole 82.

The roller installation frame 43 can be moved in the direction toward the developing roller 10. In other words, the roller installation frame 43 is attached to the turning frame 42 so that the roller installation frame 43 can be moved toward the developing roller 10 when the turning frame 42 is positioned at the developing operation position.

The roller installation frame 43 is composed of a longitudinal part 43*a* vertically extended and a lateral part 43*b* horizontally continued to a lower end portion of the longitudinal part 43*a* and laterally extended so as to be formed of a hook shape. The lateral part 43*b* is attached to the lateral part 42*b* of the turning frame 42 so as to be movable toward the developing roller 10 along a guide 42*d*.

The lateral part 43*b* of the roller installation frame 43 is formed with a long aperture 43*c* which penetrates upper and lower surfaces thereof. The long aperture 43*c* is a long aperture along the longitudinal direction of the lateral part 43*b*.

A fixing bolt 43*d* penetrates the long aperture 43*c* and is screwed in the lateral part 42*b* of the turning frame 42 and fixes the lateral part 43*b* of the roller installation frame 43 to the lateral part 42*b* of the turning frame 42.

A block 44 is fixed to the upper part of the turning frame 42. An adjustment bolt 44*a* toward the developing roller 10 is screwed in the block 44. The tip of the adjustment bolt 44*a* is in contact with the lateral part 43*b* of the roller installation frame 43.

Therefore, the roller installation frame 43 is made to get closer to or separated from the developing roller 10 by rotating the adjustment bolt 44*a* in a tightening direction or a loosening direction in the state that the fixing bolt 43*d* is loosened. If the fixing bolt 43*d* is rotated in the tightening direction, the roller installation frame 43 can be fixed. In other words, the nip width between the surface of the dual purpose roller 30 attached to the roller installation frame 43 and the surface of the developing roller 10 can be adjusted.

The wet type developing device 4 has a nip width adjustment mechanism of the configuration using a linear movement mechanism to adjust the nip width between the surface of the dual purpose roller 30 and the surface of the developing roller 10 in this way. This nip width adjustment mechanism is not limited to the above-mentioned mechanism and may be a mechanism of another configuration, e.g. the configuration using the lever mechanism that has a rotatable lever.

Then, the installation structure of the dual purpose roller 30 will be explained.

As shown in FIG. 4, the dual purpose roller 30 comprises a cylindrical metal core 31, a cylindrical coating material 32 coating the outer peripheral surface of the cylindrical metal core 31 and support shafts 33 which are inserted into and attached to both the axial ends of the cylindrical metal core 31.

A rotating body 45 is rotatably attached to the longitudinal part 43*a* of the roller installation frame 43. The rotating body 45 has an axis bearing hole 46. The support shafts 33 of the dual purpose roller 30 are inserted in the bearing holes 46, respectively and thereby the dual purpose roller 30 is rotatably supported by the rotating body 45.

The center 45*a*-1 of the outer peripheral surface 45*a* of the rotating body 45 and the center 46-1 of the bearing hole 46 are misaligned in the radial direction. In other words, the outer peripheral surface 45*a* and the bearing hole 46 are in an eccentric arrangement.

Therefore, the dual purpose roller 30 translates in the direction orthogonal to its axial direction when rotating body 45 rotates, thereby a gap between the surface of the anilox roller 20 and the surface of the dual purpose roller 30 changes.

The rotating body 45 is rotated by a rotating mechanism 90 as shown in FIGS. 3 and 4.

The rotating mechanism 90 has an arm 91 attached to the rotating body 45 and a cylinder 92 bridged between the arm 91 and the roller installation frame 43.

A bracket 93 is attached to the longitudinal part 43*a* of the roller installation frame 43.

The arm 91 is formed of L shape with one side arm part 91*a* and the other side arm part 91*b*. The cylinder 92 is bridged between the one side arm part 91*a* and the bracket 93.

Therefore, when the cylinder 92 is operated to be extended, the rotating body 45 is rotated via the arm 91 in one direction, and thereby the dual purpose roller 30 translates in the direction orthogonal to the axial direction to separate from the anilox roller 20, so that the gap between the surface of the anilox roller 20 and the surface of the dual purpose roller 30 is increased.

In addition, when the cylinder 92 is operated to be contracted, the rotating body 45 is rotated via the arm 91 in the other direction, and thereby the dual purpose roller 30 translates in the direction orthogonal to the axial direction to get closer to the anilox roller 20, so that the gap between the surface of the anilox roller 20 and the surface of the dual purpose roller 30 is decreased.

In other words, the wet type developing device 4 has a gap adjustment mechanism of the configuration using an eccentric mechanism to adjust the size of the gap between the surface of the anilox roller 20 and the surface of the dual purpose roller 30. This gap adjustment mechanism is not limited to the above-mentioned mechanism and may be a mechanism of another configuration, e.g. the configuration using the linear movement mechanism.

This gap adjustment mechanism and the nip width adjustment mechanism described above may be a mechanism of another configuration, e.g. the configuration using double eccentric mechanism which combine two eccentric mechanisms.

As shown in FIG. 4, the dual purpose roller 30 is connected to a drive source (motor) that is not illustrated through a power transmission mechanism 100 and the dual purpose roller 30 is driven to rotate by the drive source.

The power transmission mechanism 100 comprises a first gear 101 fixed to one of support shafts 33 of the dual purpose roller 30, a transmission axis 102 that penetrates one of frames 41 to project outside of the frame 41 and is rotatable, a second gear 103 fixed to axial end of the transmission axis 102 and a third gear 104 fixed to the other end of the transmission axis 102. The first gear 101 detachably meshes with the second gear 103 and the third gear 104 meshes with a drive gear (not shown).

Therefore, when the turning frame 42 is at the developing operation position, the first gear 101 meshes with the second gear 103 and the third gear 104 is driven to rotate by the drive source (not shown), so that the dual purpose roller 30 is driven to rotate.

Because the first gear 101 separates from the second gear 103 when the turning frame 42 is turned to the retreat position, the drive source does not move when the dual purpose roller 30 is moved to the retreat position, so that the power to move the dual purpose roller 30 may be small, and the wiring to the drive source is easy.

The liquid toner tank 40 shown in FIG. 3 is disposed (bridged) between the pair of frames 41.

The liquid toner supply control member 50 is located above the liquid toner tank 40 and is bridged between the internal surfaces of the pair of frames 41.

Figure 5:
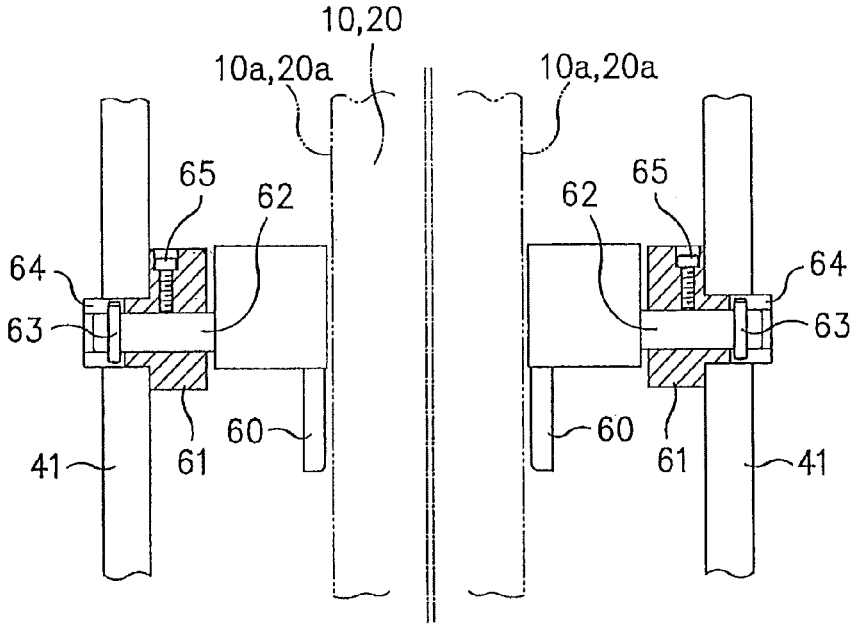
FIG. 5 is a transverse sectional view of the attaching portion of the liquid toner discharge member.

The installation structure of the liquid toner discharge member 60 will be explained based on FIG. 5. FIG. 5 is a transverse sectional view of the attaching portion of the liquid toner discharge member 60.

As shown in FIG. 5, the liquid toner discharge members 60 are attached to the internal surfaces of the pair of frames 41 so as to be movable in the axial direction of the rollers, i.e. the direction in which the liquid toner discharge members 60 get closer to or separate from both the axial end surfaces 10*a*, 20*a* of the developing roller 10 and the anilox roller 20, respectively.

As shown in FIG. 5, mounting members 61 are attached to the pair of frames 41, respectively. The liquid toner discharge member 60 has a rod 62, and the rod 62 is inserted in the mounting member 61 so as to be movable in the axial direction of the roller. A pin 63 is attached to the rod 62 so as to protrude outwardly out of the outer peripheral surface of the rod 62. This pin 63 is inserted in a slit-formed groove 64 of the mounting member 61 so that the rod 62 does not rotate. A fixation screw 65 is screwed in the mounting member 61. The rod 62 is prevented from moving in the axial direction of the roller by tightening the fixation screw 65 to push it to the rod 62.

Therefore, the liquid toner discharge member 60 can be moved in the axial direction of the roller by loosening the fixation screw 65 to allow the rod 62 to move in the axial direction of the roller.

In addition, the liquid toner discharge member 60 can be fixed not to move in the axial direction of the roller by tightening the fixation screw 65 so that the rod 62 cannot be moved in the axial direction of the roller.

In other words, the gaps between both the axial end surfaces 10*a*, 20*a* of the anilox roller 20, the developing roller 10 and the liquid toner discharge member 60 can be adjusted by moving the liquid toner discharge member 60 in the axial direction of the roller.

The installation structure of the liquid toner recovery member 70 will be explained based on FIGS. 3 and 4.

The liquid toner recovery member 70 is rotatably bridged between the other side arm parts 91*b* of the pair of the arms 91 of the rotating mechanism 90.

Because the liquid toner recovery member 70 moves to the retreat position together with the dual purpose roller 30, the inspection and maintenance of the liquid toner recovery member 70 are easy.

Figure 6:
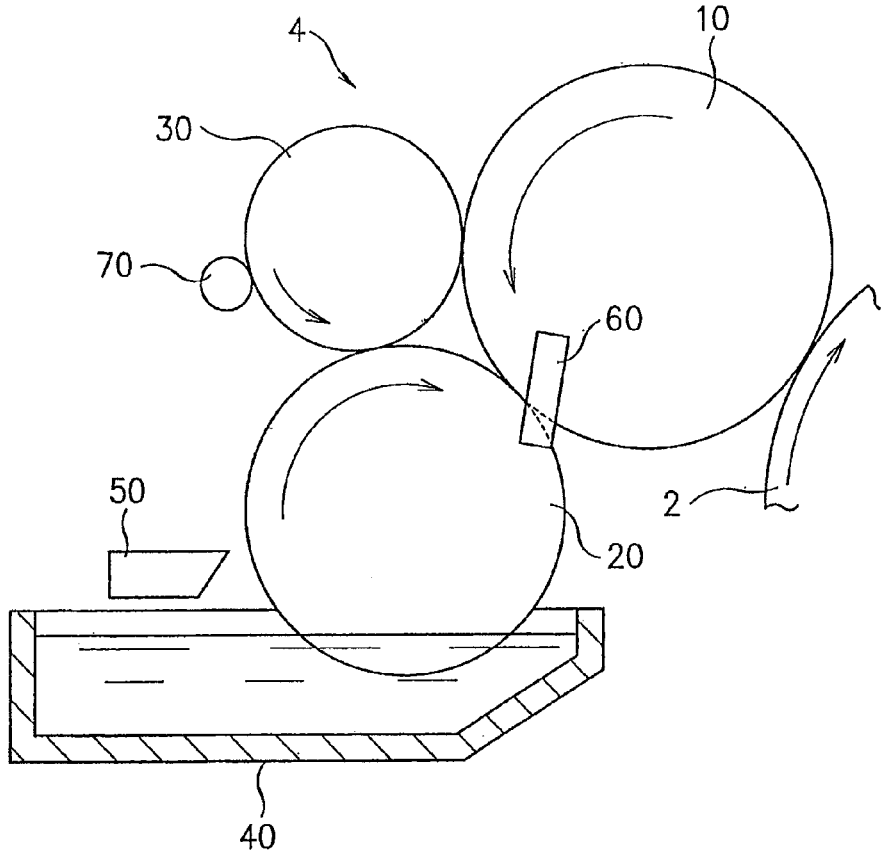
FIG. 6 is a schematic structural explanatory view illustrating a second embodiment of the wet type developing device of the present invention.

The second embodiment of the wet type developing device 4 of the present invention will be explained based on FIG. 6. FIG. 6 is a schematic structural explanatory view of the wet type developing device.

As shown in FIG. 6, this second embodiment is different from the first embodiment of the wet type developing device as shown in FIG. 2 in respect that the surface of the dual purpose roller 30 is in contact with the surface of the anilox roller 20, and is the same as the first embodiment in respect of the other structure.

In other words, as for the second embodiment of the wet type developing device, since the surface part of the dual purpose roller 30 is also formed of the porous member having flexibility and elasticity, a linear scratch does not occur on the surface of the anilox roller 20 by wearing of the dual purpose roller 30 even though the surface of the dual purpose roller 30 is in contact with the surface of the anilox roller 20.

An action of the dual purpose roller 30 to regulate the quantity of the liquid toner on the surface of the anilox roller 20 will be explained.

Since the surface of the dual purpose roller 30 is in contact with the surface of the anilox roller 20 and the dual purpose roller 30 and the anilox roller 20 is rotated in the opposite directions each other, the surface of the dual purpose roller 30 and the surface of the anilox roller 20 move in the same direction at the contact region thereof.

The coarsely adjusted liquid toner on the surface of the anilox roller 20 is dammed up in the region of contact (dual purpose roller contacting portion) with the surface of the dual purpose roller 30 by a rotation of anilox roller 20, and a part of the coarsely adjusted liquid toner is absorbed in the pores of the sponge of open cell foam or the sponge of the closed cell foam which is the surface part of the dual purpose roller 30. The sponge part which absorbed the liquid toner is compressed at the nip beginning region (contact start part) upstream of the region of contact (anilox roller contacting portion) between the surface of the dual purpose roller 30 and the surface of the anilox roller 20, and thereby the liquid toner in the pores of the sponge part is discharged. The sponge part expands (extends) and returns to its original state in the nip dissolving region (contact end part) downstream of the region of contact with the surface of the anilox roller 20, thereby the liquid toner on the surface of the developing roller 10 is absorbed into the pores of the sponge part. The quantity of absorption of this liquid toner is determined by the nip width (contact width) between the surface of the dual purpose roller 30 and the surface of the anilox roller 20.

The quantity of absorption of the liquid toner in the nip dissolving region downstream of the region of contact increases if the nip width is widened (the nip pressure is strengthened) and decreases if the nip width is narrowed.

In other words, the quantity of the liquid toner on the surface of the anilox roller 20, i.e. the liquid toner supply by the anilox roller 20 to upstream side of the region of contact between the surface of the developing roller 10 and the surface of the anilox roller 20 can be regulated by adjusting the nip width between the surface of the dual purpose roller 30 and the surface of the anilox roller 20.

The nip width between the surface of the dual purpose roller 30 and the surface of the anilox roller 20 can be adjusted by extending and contracting the cylinder 92 of the first embodiment as shown in FIGS. 3 and 4. In other words, the rotating body 45 and the cylinder 92, etc. compose the nip width adjustment mechanism to adjust the nip width between the surface of the dual purpose roller 30 and the surface of the anilox roller 20.

In the structure as shown in FIG. 6, at first the cells of the surface of the anilox roller 20 is not filled with the liquid toner and is in a condition to have lacked the quantity of the liquid toner because the liquid toner is absorbed in the pores of the sponge which expanded in the nip dissolving region downstream of the region of contact between the surface of the dual purpose roller 30 and the surface of the anilox roller 20. However, because the surface of the dual purpose roller 30 also comes in contact with the surface of the developing roller 10, the sponge composing the surface of the dual purpose roller 30 is compressed at the nip beginning region upstream of the region contact between the surface of the dual purpose roller 30 and the surface of the developing roller 10, and the liquid toner in the pores of the compressed sponge is discharged to the surface of the developing roller 10. This discharged liquid toner moves to the nip beginning region upstream of the region of contact between the surface of the developing roller 10 and the surface of the anilox roller 20 and flows in the cells of the surface of the anilox roller 20 and fills the cells with the liquid toner and supplements the lack of the liquid toner.

In this way, decreasing of the density of the liquid toner which is used for the developing at the surface of the photoconductor drum 2 by lacking of the quantity of the liquid toner to be supplied to the surface of the developing roller 10 from the surface of the anilox roller 20 can be prevented.

In other words, the liquid toner discharged to the developing roller 10 from the dual purpose roller 30, flows to the nip beginning region upstream of the region of contact between the surface of the developing roller 10 and the surface of the anilox roller 20, and thereby the nip pool of the liquid toner occurs. The liquid toner in the nip pool can make up for lack of liquid toner in the cells of the surface of the anilox roller 20.

According to the wet type developing device as shown in FIG. 6, the surface part of the dual purpose roller 30 is crushed flatly by generation of the nip at upstream side of the region of contact between the surface of the anilox roller 20 and the surface of the dual purpose roller 30 and thereby the liquid toner in the pores of the dual purpose roller 30 is discharged onto the cells of the surface of the anilox roller 20 to be stirred with the liquid toner in the cells of the anilox roller 20, and then at the nip dissolving region downstream of the region of contact, the liquid toner is absorbed from the cells of the surface of the anilox roller 20 into the pores of the sponge of the surface of the dual purpose roller 30, resulting in the advantage that can prevent the liquid toner from adhering and depositing in the cells.

To raise this advantage to the maximum, at first, all the liquid toner in the cells of the surface of the anilox roller 20 is absorbed in the pores of the sponge of open cell foam or the sponge of closed cell foam of the dual purpose roller 30 expanded at the nip dissolving region downstream of the region of contact between the surface of the anilox roller 20 and the surface of the dual purpose roller 30, and then the dual purpose roller 30 is crushed flatly by rotation of the dual purpose roller 30 at the nip beginning region upstream of the region of contact between the surface of the dual purpose roller 30 and the surface of the developing roller 10 so that the liquid toner in the pores of the dual purpose roller 30 is discharged onto the surface of the developing roller 10, and then the discharged liquid toner moves to the nip beginning region upstream of the region of contact between the surface of the developing roller 10 and the surface of the anilox roller 20, and thereby the cells of the surface of the anilox roller 20 are filled with the liquid toner so that a nip pool of the liquid toner occurs.

Figure 7:
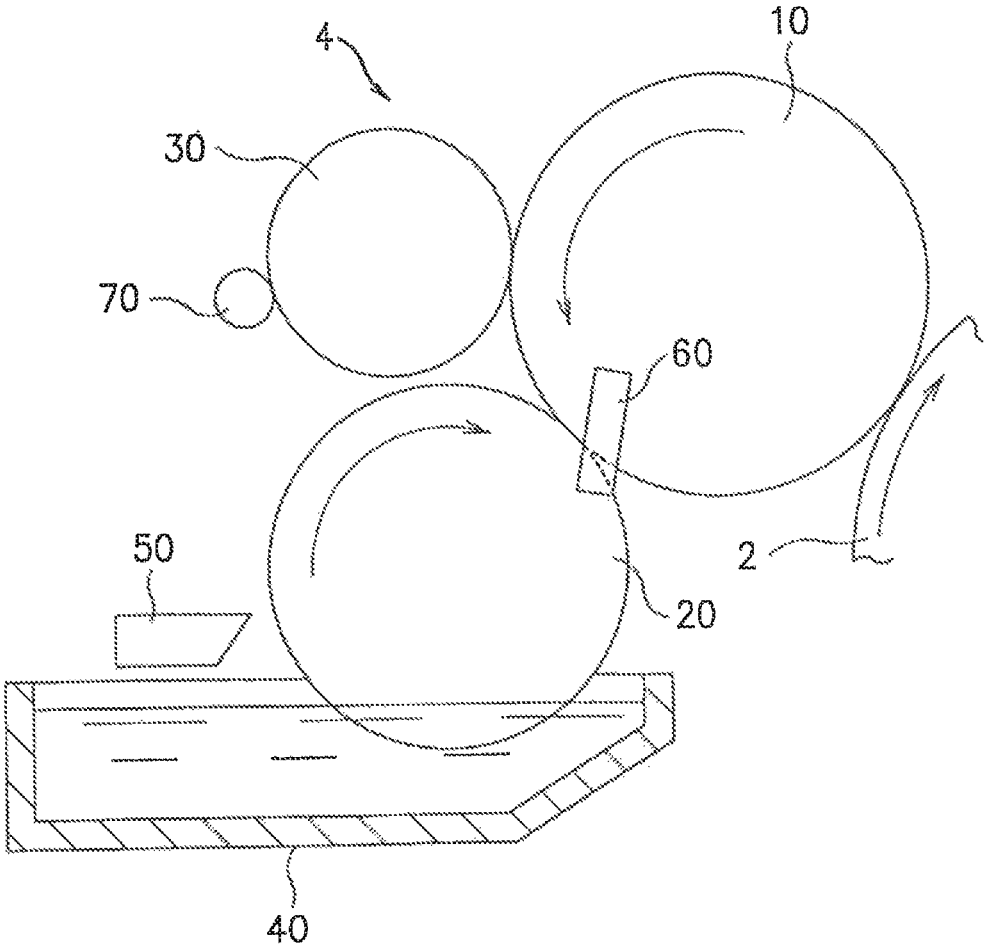
FIG. 7 is a schematic structural explanatory view illustrating a third embodiment of the wet type developing device of the present invention.

The third embodiment of the wet type developing device 4 of the present invention will be explained based on FIG. 7.

This wet type developing device 4 is similar to the first embodiment of the wet type developing device 4 shown in FIG. 2 in structure and different from the first embodiment of the wet type developing device in that the dual purpose roller 30 is always at a standstill.

An action of the dual purpose roller 30 to regulate the quantity of the liquid toner on the surface of the anilox roller 20 will be explained.

The dual purpose roller 30 is fixedly provided so that the surface thereof is opposite to the surface of the anilox roller 20 leaving a gap therebetween and is in contact with a surface part of the coarsely adjusted liquid toner layer on the surface of the anilox roller 20.

For example, the support shafts 33 of the dual purpose roller 30 are fixed to the rotating bodies 45, respectively without arranging the power transmission mechanism 100 and then the dual purpose roller 30 is fixedly attached to the roller installation frames 43 without rotating the dual purpose roller 30.

And the surface part of the coarsely adjusted liquid toner layer on the surface of the anilox roller 20 is regulated to the liquid toner layer of the predetermined thickness by contacting with the surface of the dual purpose roller 30 and thereby the quantity of the liquid toner on the surface of the anilox roller 20 is regulated. In other words, the liquid toner supply to upstream side of the region of contact between the surface of the developing roller 10 and the surface of the anilox roller 20 is regulated.

The quantity of the liquid toner on the surface of the anilox roller 20 is regulated with the size of the gap between the surface of the dual purpose roller 30 and the surface of the anilox roller 20.

For example, the quantity of the liquid toner on the surface of anilox roller 20 can be adjusted by extending and contracting the cylinder 92 as shown in FIGS. 3 and 4 so as to rotate the rotating body 45 and thereby adjusting the gap between the surface of the dual purpose roller 30 and the surface of the anilox roller 20.

In this way, the liquid toner supply by the anilox roller 20 to the upstream side of the region of contact between the surface of the developing roller 10 and the surface of the anilox roller 20 can be adjusted.

The explanation of this action is as follows.

The pores of the part opposite to the surface of the anilox roller 20, of the sponge of open cell foam or the sponge of closed cell foam composing the surface part of the dual purpose roller 30 are saturated with the liquid toner as with the wet type developing device shown in FIG. 2.

The dual purpose roller 30 dams up the part of the coarsely adjusted liquid toner on the surface of the anilox roller 20, so that the thin layer of the liquid toner overflowed from the cells is formed on the surface of the anilox roller 20.

This liquid toner layer moves to upstream side of the region of contact between the surface of the developing roller 10 and the surface of the anilox roller 20, and thereby the nip pool of the liquid toner occur in the nip beginning region upstream of the region of contact.

Therefore, the liquid toner supply by the anilox roller 20 to the upstream side of the region of contact between the surface of the developing roller 10 and the surface of the anilox roller 20 can be regulated by the dual purpose roller 30.

In addition, the adjustment of the liquid toner supply by the anilox roller 20 to the upstream side of the region of contact between the surface of the developing roller 10 and the surface of the anilox roller 20 is similar to the wet type developing device shown in FIG. 2.

An action of the dual purpose roller 30 to erase the history of the electrostatic latent image on the surface of the developing roller 10 will be explained.

The sponge of open cell foam or the sponge of closed cell foam of the dual purpose roller 30 is always constantly compressed in the region of contact with the surface of the developing roller 10, so that there are no discharge and no absorption of the liquid toner by the pores of the sponge in the nip beginning region upstream of the region of contact and the nip dissolving region downstream of the region of contact, respectively.

Because the developing roller 10 rotates while coming in contact with the surface of the dual purpose roller 30 (the compressed sponge of open cell foam or the compressed sponge of closed cell foam) which surface is at a standstill, the residual toner on the surface of the developing roller 10 is dispersed on the surface uniformly and scraped off by the sponge of the dual purpose roller 30 in the nip beginning region upstream of the region of contact between the surface of the developing roller 10 and the surface of the dual purpose roller 30.

Therefore, the history of the electrostatic latent image on the surface of the developing roller 10, of the residual liquid toner which was not transferred to the surface of the photoconductor drum 2 as an electrostatic latent image is erased.

In addition, a liquid toner is not discharged from the pores of the sponge of the dual purpose roller 30 to the surface of the developing roller 10 in the nip dissolving region downstream of the region of contact between the surface of developing roller 10 and the surface of the dual purpose roller 30.

Therefore, because the liquid toner is supplied to the surface of the developing roller 10 only from the anilox roller 20 and thereby the quantity of the liquid toner on the surface of the developing roller 10 becomes a predetermined quantity, the density of the liquid toner on the surface of the photoconductor drum 2 developed with the developing roller 10 can be always uniformized.

In this embodiment of the wet type developing device, it is not necessary to provide the liquid toner recovery member 70 because the dual purpose roller 30 does not rotate.

Figure 8:
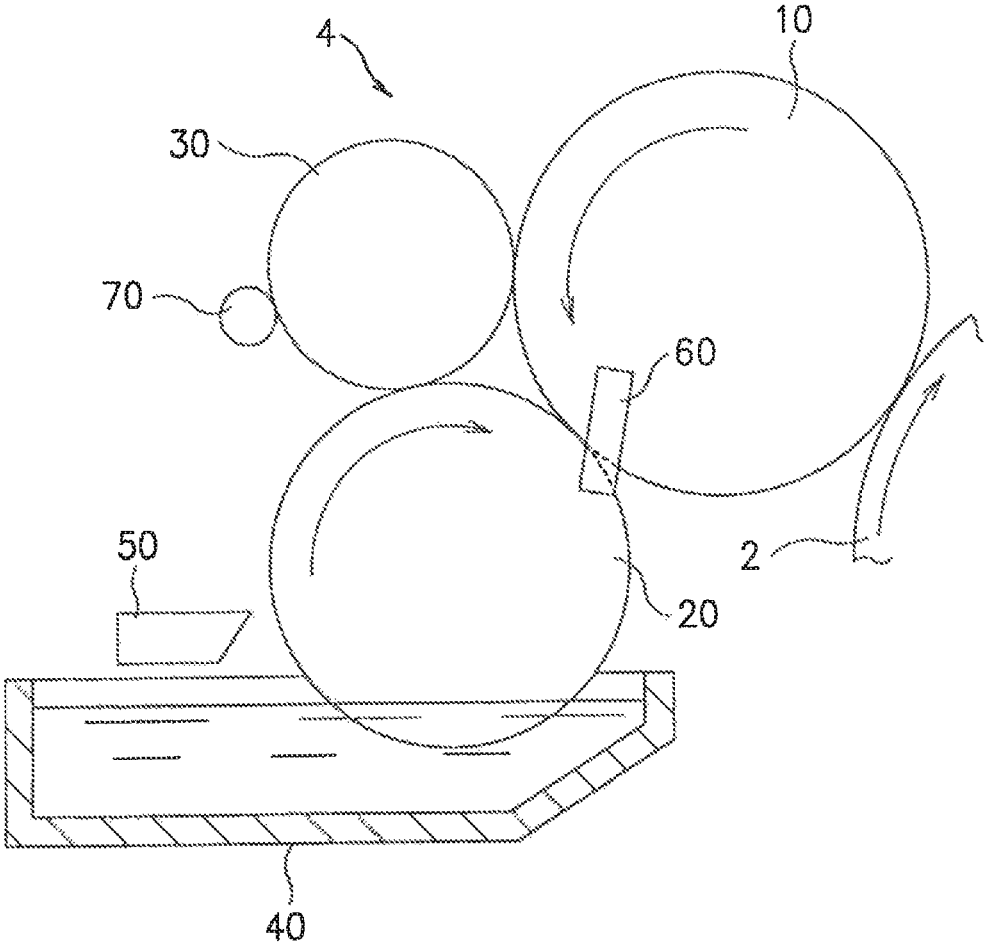
FIG. 8 is a schematic structural explanatory view illustrating a fourth embodiment of the wet type developing device of the present invention.

The fourth embodiment of the wet type developing device 4 will be explained based on FIG. 8.

This wet type developing device 4 is similar to the second embodiment of the wet type developing device 4 shown in FIG. 6 in structure and different from the second embodiment of the wet type developing device in that the dual purpose roller 30 is always at a standstill.

An action of the dual purpose roller 30 to regulate the quantity of the liquid toner on the surface of the anilox roller 20 will be explained.

The sponge of open cell foam or the sponge of closed cell foam of the dual purpose roller 30 is always constantly compressed in the region of contact with the surface of the anilox roller 20, so that there are no discharge and no absorption of the liquid toner by the pores of the sponge in the nip beginning region upstream of the region of contact and the nip dissolving region downstream of the region of contact, respectively.

A coarsely adjusted liquid toner layer on the surface of the anilox roller 20 is scraped off in the nip beginning region upstream of the region of contact with the dual purpose roller 30 which is at a standstill and thereby a liquid toner is suitably filled in the cells of the surface of the anilox roller 20. The liquid toner filled in the cells of the surface of the anilox roller 20 is moved to the region of contact between the surface of the developing roller 10 and the anilox roller 20.

In this way, with the dual purpose roller 30, a liquid toner supply by the anilox roller 20 to the upstream side of the region of contact between the surfaces of the developing roller 10 and the anilox roller 20 can be regulated.

The action of the dual purpose roller 30 to erase the history of the electrostatic latent image on the surface of the developing roller 10 is similar to the third embodiment.

In this embodiment of the wet type developing device, it is not necessary to provide the liquid toner recovery member 70 because the dual purpose roller 30 does not rotate.

What is claimed is:

1. A wet type developing device comprising a developing roller being in contact with a surface of a photoconductor drum and an anilox roller being in contact with a surface of the developing roller and having a surface in part immersed in a liquid toner whereby an electrostatic latent image formed on the surface of the photoconductor drum is developed with the liquid toner supplied to the surface of the developing roller from the anilox roller, the wet type developing device further comprises:

a dual purpose roller being opposite to the surface of the anilox roller, leaving a gap therebetween which is smaller than a thickness of a liquid toner layer attached to the surface of the anilox roller, upstream of a region of contact between the surfaces of the anilox roller and the developing roller and being in contact with the surface of the developing roller upstream of the region of contact between the surfaces of the anilox roller and the developing roller and being rotationally driven, wherein a surface part of the dual purpose roller consists of a porous member which has flexibility and elasticity.

2. The wet type developing device as set forth in claim 1, the wet type developing device further comprises:

a gap adjustment mechanism to adjust the size of a gap between the surface of the anilox roller and the surface of the dual purpose roller.

3. The wet type developing device as set forth in claim 1, wherein the porous member which composes the surface part of the dual purpose roller and has flexibility and elasticity is a sponge of open cell foam.

4. The wet type developing device as set forth in claim 1, wherein the porous member which composes the surface part of the dual purpose roller and has flexibility and elasticity is a sponge of closed cell foam.

5. The wet type developing device as set forth in claim 1, wherein the dual purpose roller rotates in the same direction as the developing roller and thereby the surface of the dual purpose roller moves in a direction opposite to a movement direction of the surface of the developing roller in the region of contact with the surface of developing roller rubbing with each other.

6. The wet type developing device as set forth in claim 1, wherein a circumferential speed of the dual purpose roller is slower than a circumferential speed of the anilox roller.

7. The wet type developing device as set forth in claim 1, the wet type developing device further comprises:

a liquid toner supply control member to coarsely adjust a liquid toner supply to upstream side of a dual purpose roller opposing region on the surface of the anilox roller.

8. The wet type developing device as set forth in claim 1, the wet type developing device further comprises:

a liquid toner recovery member being disposed to be pressed against the surface of the dual purpose roller between upstream side of an anilox roller opposing portion and downstream side of a developing roller contact portion.

9. A wet type developing device comprising a developing roller being in contact with a surface of a photoconductor drum and an anilox roller being in contact with a surface of the developing roller and having a surface in part immersed in a liquid toner whereby an electrostatic latent image formed on the surface of the photoconductor drum is developed with the liquid toner supplied to the surface of the developing roller from the anilox roller, the wet type developing device further comprises:

a dual purpose roller being in contact with the surface of the anilox roller upstream of a region of contact between the surfaces of the anilox roller and the developing roller and being in contact with the surface of the developing roller upstream of the region of contact between the surfaces of the anilox roller and the developing roller and being rotationally driven, wherein a surface part of the dual purpose roller consists of a porous member which has flexibility and elasticity.

10. The wet type developing device as set forth in claim 1 or claim 9, the wet type developing device further comprises:

a liquid toner discharge member for discharging, a surplus liquid toner in a nip beginning region upstream of the region of contact between the surfaces of the anilox roller and the developing roller, into a liquid toner tank.

11. The wet type developing device as set forth in claim 9, the wet type developing device further comprises:

a nip width adjustment mechanism to adjust a nip width between the surface of the anilox roller and the surface of the dual purpose roller.

12. The wet type developing device as set forth in any one of claims 1, 9, and 2 to 4, wherein a difference between a circumferential speed of the anilox roller and a circumferential speed of the developing roller is made.

13. The wet type developing device as set forth in claim 9, wherein the porous member which composes the surface part of the dual purpose roller and has flexibility and elasticity is a sponge of open cell foam.

14. The wet type developing device as set forth in claim 9, wherein the porous member which composes the surface part of the dual purpose roller and has flexibility and elasticity is a sponge of closed cell foam.

15. The wet type developing device as set forth in claim 13 or claim 14, wherein a difference between a circumferential speed of the anilox roller and a circumferential speed of the developing roller is made.

16. The wet type developing device as set forth in claim 9, wherein the dual purpose roller rotates in the same direction as the developing roller and thereby the surface of the dual purpose roller moves in a direction opposite to a movement direction of the surface of the developing roller in the region of contact with the surface of developing roller rubbing with each other.

17. The wet type developing device as set forth in claim 9, wherein a circumferential speed of the dual purpose roller is slower than a circumferential speed of the anilox roller.

18. The wet type developing device as set forth in claim 9, the wet type developing device further comprises:

a liquid toner supply control member to coarsely adjust a liquid toner supply to upstream side of a dual purpose roller contacting portion on the surface of the anilox roller.

19. The wet type developing device as set forth in claim 9, the wet type developing device further comprises:

a liquid toner recovery member being disposed to be pressed against the surface of the dual purpose roller between upstream side of an anilox roller contacting portion and downstream side of a developing roller contact portion.

20. A wet type developing device comprising a developing roller being in contact with a surface of a photoconductor drum and an anilox roller being in contact with a surface of the developing roller and having a surface in part immersed in a liquid toner whereby an electrostatic latent image formed on the surface of the photoconductor drum is developed with the liquid toner supplied to the surface of the developing roller from the anilox roller, the wet type developing device further comprises:

a dual purpose roller being opposite to the surface of the anilox roller, leaving a gap therebetween which is smaller than a thickness of a liquid toner layer attached to the surface of the anilox roller, upstream of a region of contact between the surfaces of the anilox roller and the developing roller and being in contact with the surface of the developing roller upstream of the region of contact between the surfaces of the anilox roller and the developing roller and being at a standstill, wherein a surface part of the dual purpose roller consists of a porous member which has flexibility and elasticity.

21. A wet type developing device comprising a developing roller being in contact with a surface of a photoconductor drum and an anilox roller being in contact with a surface of the developing roller and having a surface in part immersed in a liquid toner whereby an electrostatic latent image formed on the surface of the photoconductor drum is developed with the liquid toner supplied to the surface of the developing roller from the anilox roller, wherein the wet type developing device further comprises:

a dual purpose roller being in contact with the surface of the anilox roller upstream of a region of contact between the surfaces of the anilox roller and the developing roller and being in contact with the surface of the developing roller upstream of the region of contact between the surfaces of the anilox roller and the developing roller and being at a standstill, wherein a surface part of the dual purpose roller consists of a porous member which has flexibility and elasticity.

* * * * *